US011021857B2

(12) United States Patent
Juan et al.

(10) Patent No.: US 11,021,857 B2
(45) Date of Patent: Jun. 1, 2021

(54) MICRO BUBBLE GENERATING DEVICE

(71) Applicants: Ching-Yuan Juan, Kaohsiung (TW); Yi-Hung Juan, Kaohsiung (TW); Cheng-Lung Juan, Kaohsiung (TW)

(72) Inventors: Ching-Yuan Juan, Kaohsiung (TW); Yi-Hung Juan, Kaohsiung (TW); Cheng-Lung Juan, Kaohsiung (TW)

( * ) Notice: Subject to any disclaimer, the term of this patent is extended or adjusted under 35 U.S.C. 154(b) by 252 days.

(21) Appl. No.: 16/395,355

(22) Filed: Apr. 26, 2019

(65) Prior Publication Data

US 2019/0330829 A1 Oct. 31, 2019

(30) Foreign Application Priority Data

Apr. 27, 2018 (TW) ..... 107114498

(51) Int. Cl.
*E03C 1/084* (2006.01)
*B01F 3/04* (2006.01)

(52) U.S. Cl.
CPC ..... *E03C 1/084* (2013.01); *B01F 3/04262* (2013.01); *B01F 2003/04297* (2013.01); *B01F 2003/04375* (2013.01); *B01F 2003/04858* (2013.01); *B01F 2003/04872* (2013.01); *B01F 2215/008* (2013.01)

(58) Field of Classification Search
CPC ..... B01F 3/04262; B01F 3/04503; B01F 5/0415; B01F 5/0644; B01F 5/0693; B01F 2003/04297; B01F 2003/04375; B01F 2003/04858; B01F 2003/04872; B01F 2215/008; B01F 2215/0052; B05B 7/0425; E03C 1/084; F16K 47/08
USPC ..... 261/75, 76, 77, DIG. 75
See application file for complete search history.

(56) References Cited

U.S. PATENT DOCUMENTS 2,747,930 A * 5/1956 Hyde ..... E03B 9/20 239/27
2,799,487 A * 7/1957 Aghnides ..... E03C 1/084 261/76
2,990,885 A * 7/1961 Brazier ..... B01F 5/0406 169/44
3,554,451 A * 1/1971 Aghnides ..... E03C 1/084 239/428.5
4,403,739 A * 9/1983 Knapp ..... E03C 1/084 239/428.5
9,016,602 B2 * 4/2015 Grether ..... E03C 1/08 239/428.5

(Continued)

*Primary Examiner* — Charles S Bushey
(74) *Attorney, Agent, or Firm* — Muncy, Geissler, Olds & Lowe, P.C.

(57) ABSTRACT

A micro bubble generating device disposed at one end of a liquid supply device including a water inlet unit, a water outlet unit, an air inlet groove, and a first sleeve. The water inlet unit is penetrated by first passages, and one side being penetrated is provided with a first connecting surface; the water outlet unit is penetrated by second passages, and one side being penetrated is provided with a second connecting surface. The second connecting surface faces the first connecting surface, and they partially abut against each other to form the air inlet groove. The air inlet groove comprises a third passage and a first accommodating chamber. The first accommodating chamber has a first spacing, the first spacing is different from a second spacing of the third passage. The first sleeve is disposed at another side of the water outlet unit.

18 Claims, 9 Drawing Sheets

(56) References Cited

U.S. PATENT DOCUMENTS

| | | | | |
|---|---|---|---|---|
| 10,695,726 | B2 * | 6/2020 | Tian | B01F 7/00241 |
| 2017/0304782 | A1 * | 10/2017 | Wu | B01F 5/0688 |
| 2019/0060846 | A1 * | 2/2019 | Juan | B01F 3/04503 |

* cited by examiner

MICRO BUBBLE GENERATING DEVICE

FIELD OF THE INVENTION

The present invention relates to a micro bubble generating device, and more particularly to a micro bubble generating device for softening the water, increasing the air content of the water and improving the fineness of the bubbles.

BACKGROUND OF THE INVENTION

The conventional aerator is mainly composed of a pump, a water outlet tube communicating with the pump, and an air-liquid mixing tube connecting the water outlet tube. The water outlet tube diameter is tapered from the pump toward the air-liquid mixing tube. The air-liquid mixing tube comprises a conduit connecting the water outlet tube, and an air inlet tube communicating with the outside air, and the conduit has a diameter larger than that of the water outlet tube. When the pump draws the water out and pressurizes it to send to the junction of the water outlet tube and the conduit, the water will form a negative pressure after entering the conduit, and the negative pressure will cause the outside air to be sucked into the air-liquid mixing tube from the air inlet tube, and the air is mixed with the water to form bubbles. The mixed bubble water is guided to an object to be washed, the objective of rinsing and sterilizing through the aeration of water can be achieved. If the aeration is used to rinse vegetables, purified water with high air content also has the effect of decomposing pesticides.

However, when the water of the conventional aerator structure flows through the air-liquid mixing tube, the bubble volume is determined by the volume of the air inlet tube and the water pressure of the pump. In addition, the water pressure of the pump must maintain the water above a specific flow rate in order that the air can be drawn in to form an air-liquid mixture. Therefore, under the premise of unable to change the water pressure or reduce the flow rate arbitrarily, the user cannot use the conventional aerator structure to change the average volume of bubbles generated in the air-liquid mixing tube, so when the user needs finer bubbles for water purification, the conventional aerators cannot meet the requirement. In addition, the air-liquid mixture produced by the aforementioned bubble mixing device has a very low air content, and the bubble volume is large, so it is difficult to maintain the shape of the bubble for a long time, also it is required to match with a high water pressure to be possible of producing an air-liquid mixture with an air content, and it is not possible to produce an air-liquid mixture with a milky white color containing a large amount of dense and fine bubbles. Therefore, how to improve the drawbacks of the aforementioned prior art is an issue that the industry is eager to overcome.

SUMMARY OF THE INVENTION

An object of the present invention is to improve the problems that the conventional air-liquid mixing device cannot be used in a low water pressure state or the outputted air-liquid mixture is insufficient in the amount of bubbles, and the density and fineness of bubbles are insufficient.

In order to achieve the above object, the present invention provides a micro bubble generating device disposed at one end of a liquid supply device. The micro bubble generating device comprises a water inlet unit, a water outlet unit, an air inlet groove, and a first sleeve. The water inlet unit comprises at least one first passage penetrating the water inlet unit, and a side of the water inlet unit penetrated by the first passage is provided with a first connecting surface; the water outlet unit comprises at least one second passage penetrating the water outlet unit, and a side of the water outlet unit penetrated by the second passage is provided with a second connecting surface, wherein the water inlet unit is disposed on the water outlet unit, and the first connecting surface and the second connecting surface partially abut against each other to form the air inlet groove between the first connecting surface of the water inlet unit and the second connecting surface of the water outlet unit, and the second passage communicates with the first passage, and the air inlet groove communicates an external air with the first passage and the second passage. The air inlet groove comprises a third passage and a first accommodating chamber circumferentially disposed around the third passage, the first accommodating chamber has a first spacing disposed perpendicularly to and between the first connecting surface and the second connecting surface, and the third passage has a second spacing between the first connecting surface and the second connecting surface. Wherein the first spacing is different from the second spacing; the first sleeve is disposed at a side of the water outlet unit opposite to the second connecting surface, the first sleeve is formed with a first side wall parallel to a first direction, an end of the first sleeve is formed with a first flange parallel to a second direction, and the first direction is orthogonal to the second direction.

Further, the first connecting surface of the water inlet unit is disposed with an abutting portion protruding toward the second connecting surface of the water outlet unit, the abutting portion is abutted at the second connecting surface, and the third passage is circumferentially disposed around the abutting portion. The first side wall of the first sleeve is disposed with at least one venting through hole communicating with the first accommodating chamber at a position opposite to the first accommodating chamber, and the water inlet unit and the water outlet unit are accommodated in the first sleeve.

Further, an end of the first passage is defined as a first water inlet and another end of the first passage is defined as a first water outlet, the first water outlet is located at the first connecting surface, and the first passage is tapered from the first water inlet toward the first water outlet.

Further, an end of the second passage is defined as a second water inlet and another end is defined as a second water outlet, a water guiding portion is disposed between the second water inlet and the second water outlet. The second water inlet is located at the second connecting surface, and is tapered toward the water guiding portion. The second water outlet is enlarged in parallel with the first direction and away from the water guiding portion.

Further, the water guiding portion has a third spacing at the second direction, and a length ratio of the second spacing to the third spacing is between 1:20 and 1:100.

Further, the first water outlet has a fourth spacing at the second direction, and a length ratio of the second spacing to the fourth spacing is greater than 1:1 and less than or equal to 1:3.

Further, when viewed in the cross-sectional direction, the fourth spacing of the first water outlet is smaller than the second water inlet at an extending position of the second connecting surface.

Further, the first spacing is greater than the second spacing.

Further, the second connecting surface of the water outlet unit is disposed with an abutting portion protruding toward the first connecting surface of the water inlet unit, the abutting portion is abutted at the first connecting surface, and the third passage is circumferentially disposed around the abutting portion.

Further, the water outlet unit is formed with a second side wall parallel to the first direction, the second side wall is circumferentially disposed around the water inlet unit and the first side wall, and the second side wall is disposed with at least one venting through hole corresponding to the first accommodating chamber and communicating with the first accommodating chamber.

Further, the water inlet unit is formed with a third side wall parallel to the first direction, the third side wall is circumferentially disposed around the water outlet unit and the first side wall, and the third side wall is disposed with at least one venting through hole corresponding to the first accommodating chamber and communicating with the first accommodating chamber.

Further, the micro bubble generating device further comprises a second sleeve, the second sleeve accommodates the water inlet unit, the water outlet unit, the air inlet groove and the first sleeve, and fixes the micro bubble generating device to the liquid supply device.

Further, the micro bubble generating device comprises a aerator mesh assembly disposed between the water outlet unit and the first sleeve, wherein the aerator mesh assembly comprises at least one partition and at least one aerator mesh disposed at a side of the partition along the first direction, the partition has a fourth passage penetrating through the partition, the fourth passage communicates with the second passage, and each of the aerator meshes further has a plurality of sieve holes.

Further, the farther a number of the aerator mesh disposed between the two adjacent partitions is from the second connecting surface, the greater the number of the aerator mesh disposed between the partitions.

Further, a size of each of the sieve holes is between 0.048 mm and 0.3 mm.

Further, another side of the partition along the first direction disposed with at least one aerator mesh, a number of the aerator meshes disposed at the two sides of the partition is increased as a distance from the second connecting surface is increased, and projections of the sieve holes of the aerator meshes disposed at two sides of the partition onto the second connecting surface is smaller as the distance from the second connecting surface is increased.

Further, a height of each of the partitions at the first direction is preferably between 0.2 mm and 1 mm.

Therefore, through the third passage of the air inlet groove and the first accommodating chamber circumferentially disposed around the third passage, when arbitrary water flows through the water inlet unit and the water outlet unit, the present invention allows the outside air to be capable of simply passing through the venting through hole, the first accommodating chamber, and the third passage of the air inlet groove, so that the outside air enters the second passage after generating sound wave oscillation through the air inlet groove to mix air with liquid, and then air bubbles in the water are further cut and refined by the aerator meshes. Additionally, the air inlet groove further utilizes the arrangement of the first accommodating chamber and the third passage having a shorter length, so that the water under any water pressure can contain a large amount of dense and fine bubbles, thereby the present invention not only reduces the water pressure requirement of the water for the micro bubble generating device to generate the negative pressure, but also increases the efficiency of air-liquid mixing.

DETAILED DESCRIPTION OF THE PREFERRED EMBODIMENTS

The technical features and operation modes of the present application described in the following preferred embodiments in conjunction with the accompanying figures are provided as reference for examining. Further, the proportions in figures of the present invention are not necessarily drawn according to actual scales in order to facilitate illustrating. The proportions in the figures are not intended to limit the scope of the requested claims.

Furthermore, the ordinal numbers such as "first", "second", and the like used in the specification and the claims to modify the elements of the claims, are not intended to mean and represent that the claimed elements have any preceding ordinal numbers, nor do they represent the order of a claimed element and another claimed element, or the order of the manufacturing method. The use of these ordinal numbers are only used to make a claimed element with a certain name distinguishable from another claimed element with the same name.

In addition, the positions mentioned in the specification and the claims, such as "on", "upper", "above", "under", "lower" or "below", can mean that the two elements are in direct contact, or the two elements are not in direct contact. When a value is defined between a first value and a second value, the defined value comprises the first value, the second value, or any value between the first value and the second value.

Furthermore, the features of the various embodiments disclosed herein can be combined with one another to form another embodiment.

Figure 1:
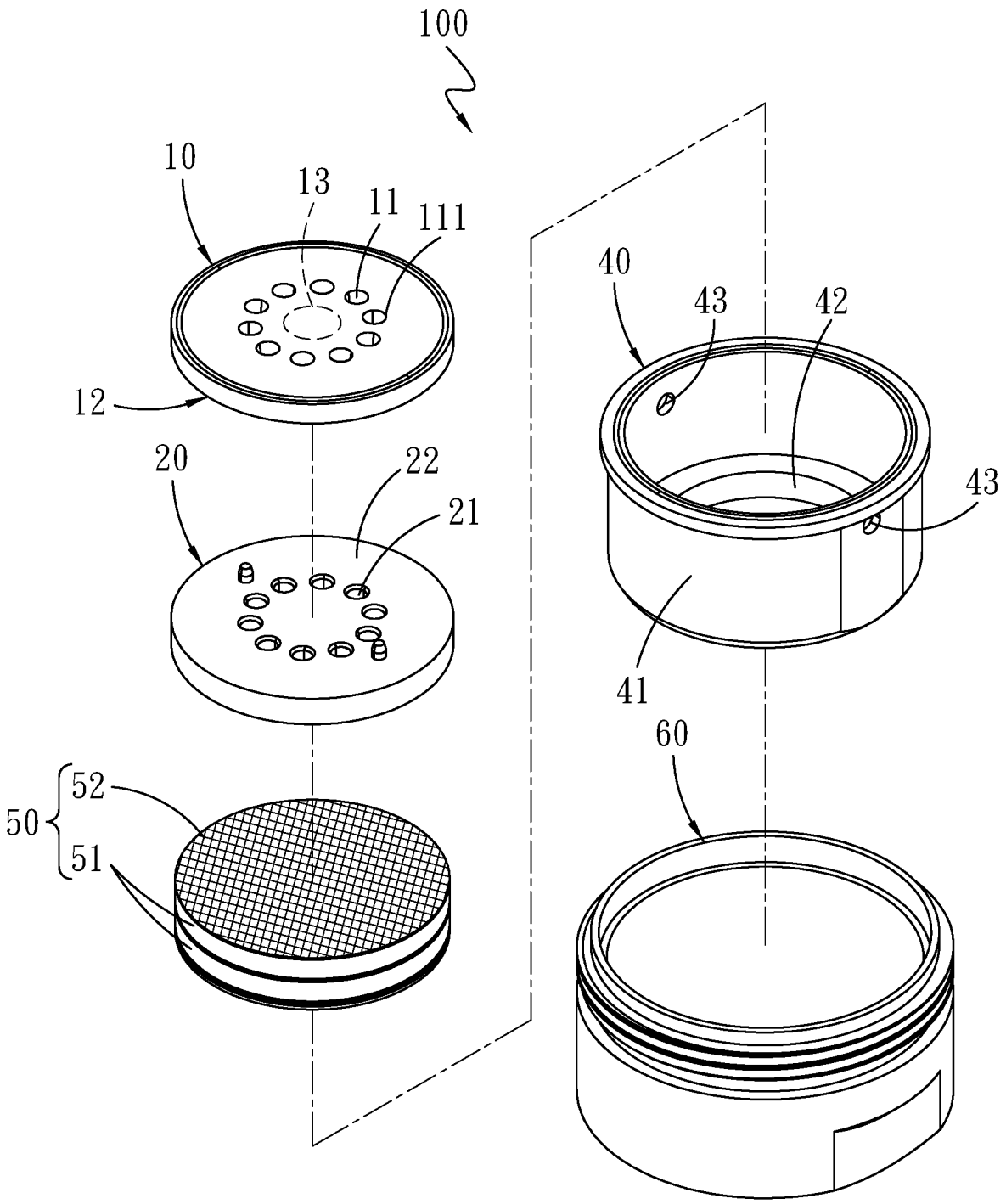
FIG. 1 is an exploded perspective view of a first embodiment of the present invention.
Figure 2:
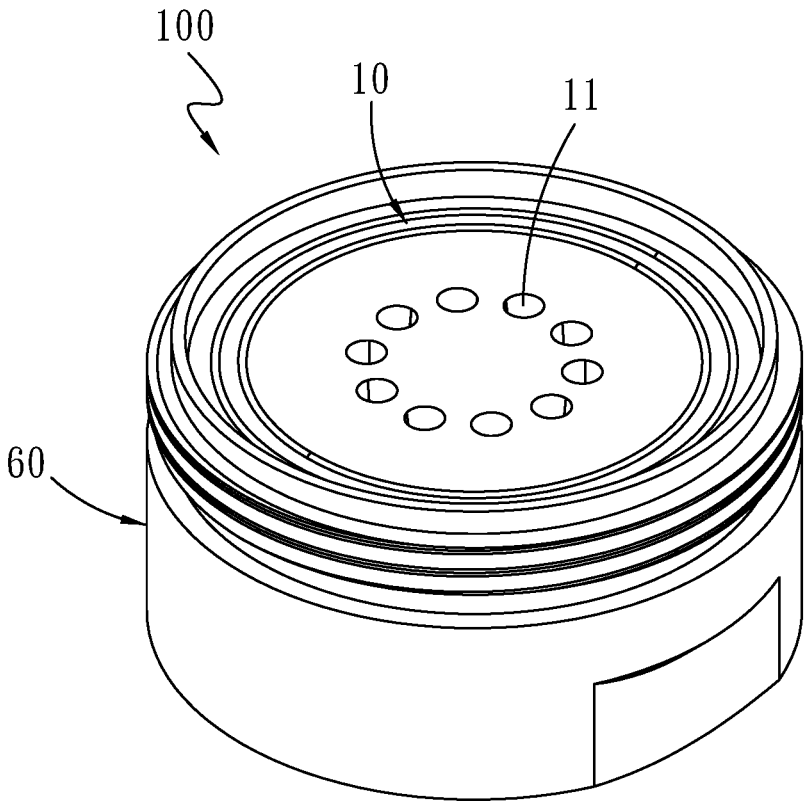
FIG. 2 is a perspective combination view of the first embodiment of the present invention.
Figure 4:
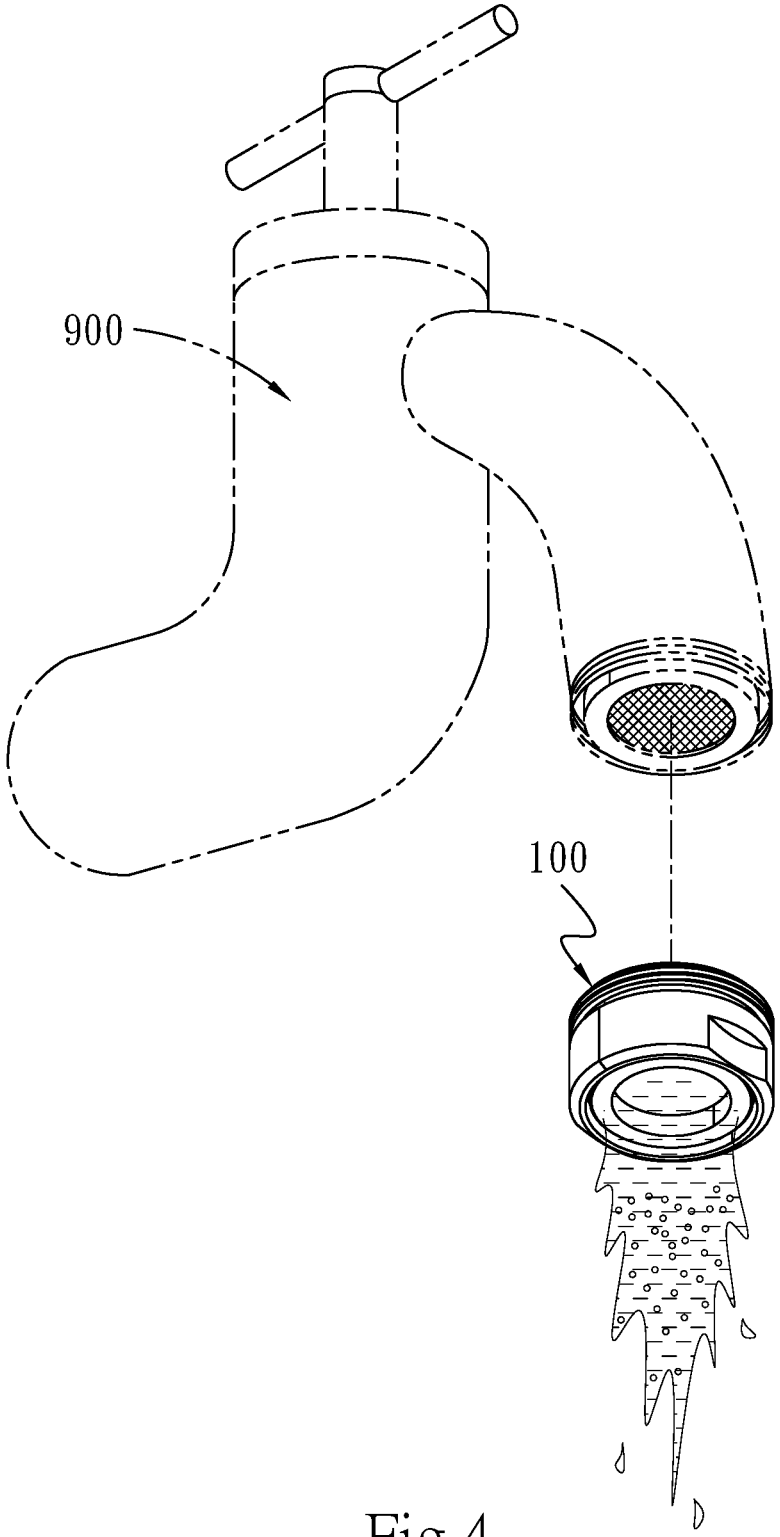
FIG. 4 is a schematic view of the state of use of the first embodiment of the present invention.

For the techniques of the present invention, please refer to FIG. 1, FIG. 2 and FIG. 4. The present invention provides a micro bubble generating device 100 disposed at one end of a liquid supply device 900, and the liquid supply device 900 can be a shower nozzle, a faucet, etc. The micro bubble generating device 100 causes the water to contain a large amount of fine bubbles, raises the air content in the water, and enhances the washing ability by rubbing a surface of an object to be washed by the bubbles. The micro bubble generating device 100 can be disposed at an internal tube line of the liquid supply device 900, or can be installed outside the liquid supply device 900 as shown in FIG. 4, and is not limited in the present invention.

Figure 3:
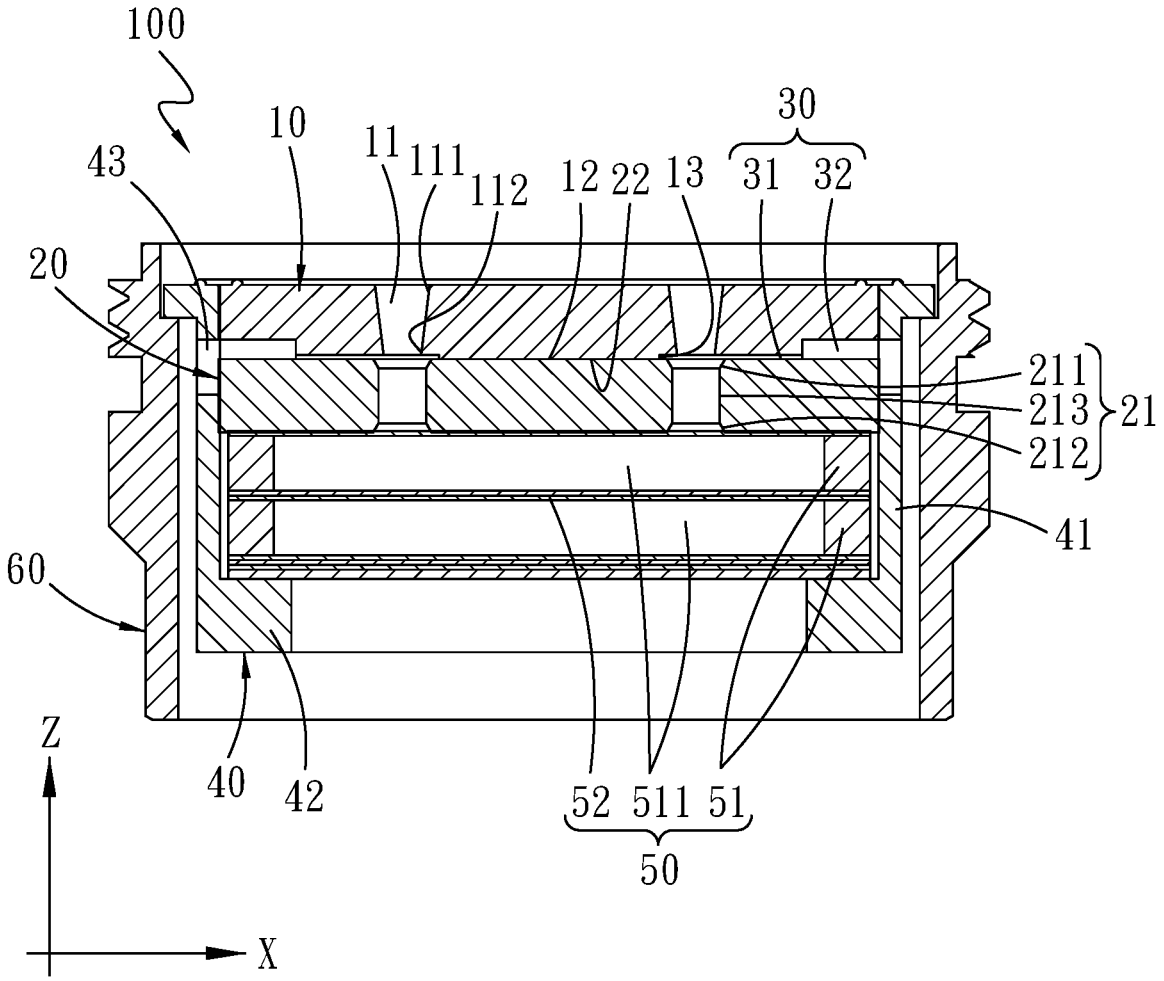
FIG. 3 is a cross-sectional view of the first embodiment of the present invention.
Figure 5:
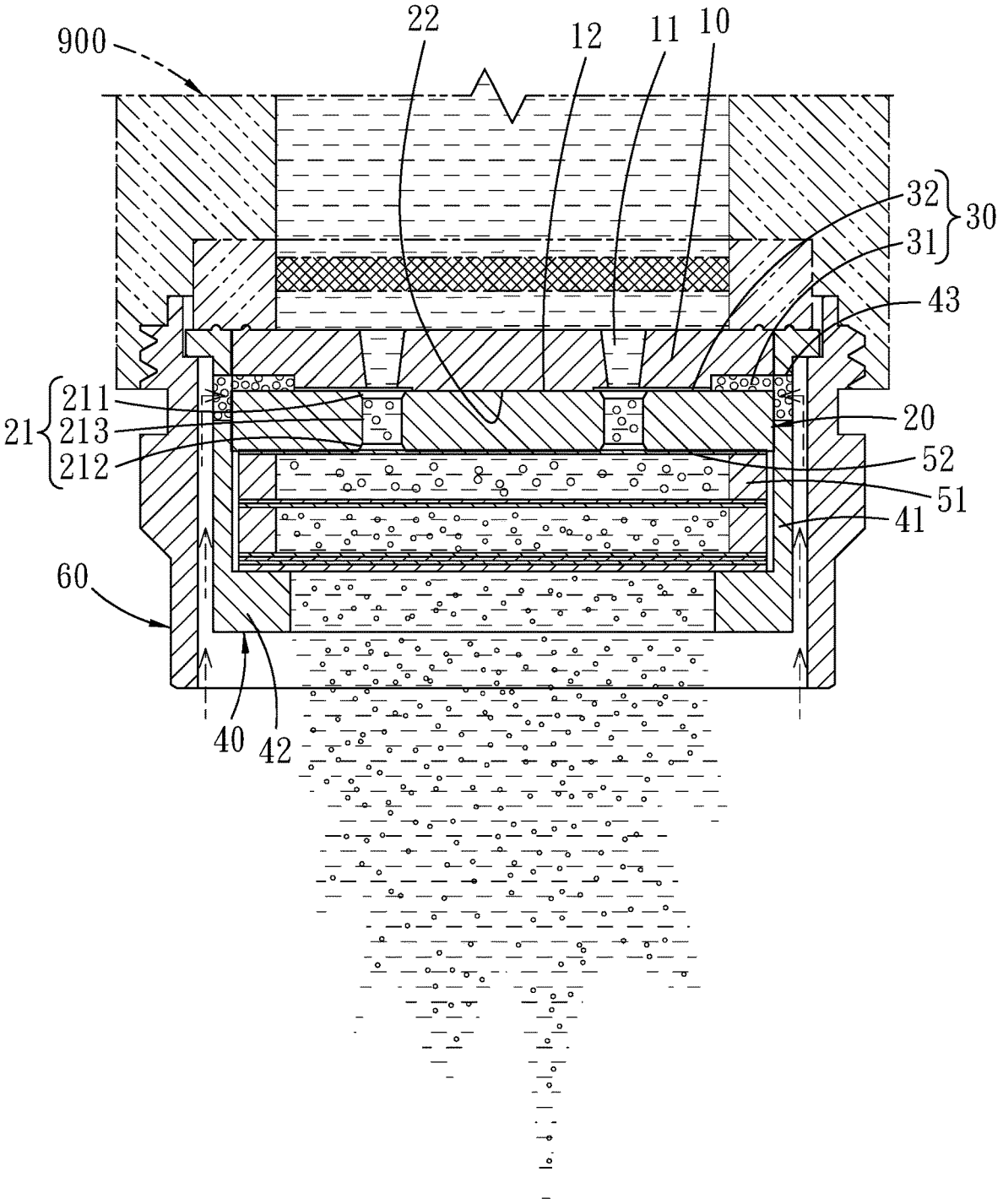
FIG. 5 is a cross-sectional view of the state of use of the first embodiment of the present invention.

Specifically, as shown in FIG. 1, FIG. 3 and FIG. 5, the micro bubble generating device 100 comprises a water inlet unit 10, a water outlet unit 20, an air inlet groove 30, a first sleeve 40, a aerator mesh assembly 50 and a second sleeve 60. The water inlet unit 10 comprises at least one first passage 11 penetrating through the water inlet unit 10, wherein a side of the water inlet unit 10 is defined as a first connecting surface 12, and one end of the first passage 11 which is located at the first connecting surface 12 is defined as a first water outlet 112, and another end of the first passage 11 is defined as a first water inlet 111. The first passage 11 is tapered from the first water inlet 111 toward the first water outlet 112. In one embodiment, the water inlet unit 10 comprises a plurality of the first passages 11. The water outlet unit 20 comprises at least one second passage 21 penetrating through the water outlet unit 20, wherein a side of the water outlet unit 20 facing the first connecting surface 12 is defined as a second connecting surface 22, and the second connecting surface 22 and the first connecting surface 12 partially abut against each other. One end of the second passage 21 which is located at the second connecting surface 22 is defined as a second water inlet 211 communicating with the first water outlet 112, and another end of the second passage 21 is defined as a second water outlet 212. Further, a water guiding portion 213 is disposed between the second water inlet 211 and the second water outlet 212. The air inlet groove 30 is formed between the first connecting surface 12 of the water inlet unit 10 and the second connecting surface 22 of the water outlet unit 20, and the air inlet groove 30 comprises a third passage 31 and a first accommodating chamber 32 circumferentially disposed around the third passage 31. The first accommodating chamber 32 communicates with external air (not labeled with number, as indicated by circles shown in FIG. 5), allowing the external air to pass through the first accommodating chamber 32 and then pass through the third passage 31 to mix with the water which passes through the first passage 11. The air then flows into the second passage 21, as indicated by a dotted line arrow as an external air path. The first sleeve 40 is disposed at another side of the water outlet unit 20 opposite to the second connecting surface 22. The first sleeve 40 is formed with a first side wall 41 parallel to a first direction Z and a first flange 42 parallel to a second direction X and connected to the first side wall 41. The first direction Z is orthogonal to the second direction X. The aerator mesh assembly 50 is disposed between the water outlet unit 20 and the first sleeve 40, and the aerator mesh assembly 50 comprises at least one partition 51 and at least one aerator mesh 52, the at least one aerator mesh 52 is disposed at least one side of the partition 51 along the first direction Z. Each of the partitions 51 is penetrated by a fourth passage 511, and at least one of the aerator meshes 52 is disposed between the two adjacent partitions 51. Please refer to FIG. 9, two sides of the partitions 51 in this embodiment are both disposed with the at least one aerator mesh 52, and each of the aerator meshes 52 comprises a plurality of sieve holes 521. Further, comparing the amounts of the aerator meshes 52 disposed at the two sides of the partition 51, the side which is farther from the second connecting surface 22 is disposed with a larger amounts of the aerator meshes 52. Besides, the larger amount of the aerator meshes 52 corresponds to the smaller size of the sieve holes 521 projected onto the second connecting surface 22. That is, the size of the sieve holes 521 of three aerator meshes 52 is smaller than the one of two aerator meshes 52 when projecting on the second connecting surface 22. Moreover, the second sleeve 60 is able to accommodate the water inlet unit 10, the water outlet unit 20, the air inlet groove 30, the aerator mesh assembly 50, and the first sleeve 40. Besides, the second sleeve 60 can fix the micro bubble generating device 100 on the liquid supply device 900.

Figure 6:
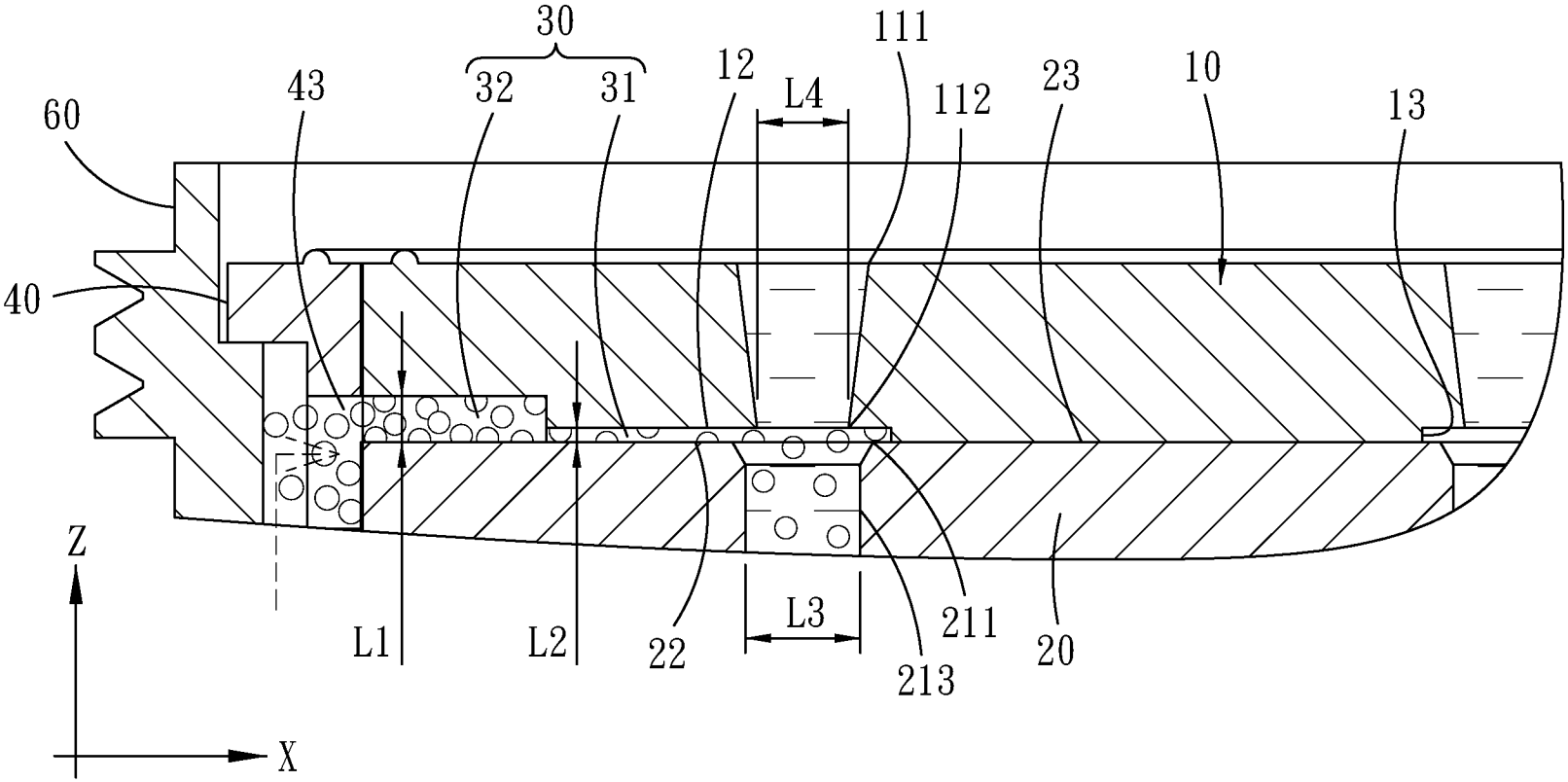
FIG. 6 is a partial enlarged view of the first embodiment of the present invention.

Referring to FIG. 3, FIG. 5 and FIG. 6, in this embodiment, the first accommodating chamber 32 has a first spacing L1 between the first connecting surface 12 and the second connecting surface 22, and the third passage 31 has a second spacing L2 between the first connecting surface 12 and the second connecting surface 22, wherein the first spacing L1 is different from the second spacing L2. In this embodiment, the first spacing L1 is greater than the second spacing L2. The first spacing L1 refers to a distance between the first connecting surface 12 and the second connecting surface 22 at the first accommodating chamber 32, and the second spacing L2 refers to a distance between the first connecting surface 12 and the second connecting surface 22 at the third passage 31. Further, due to errors of manufacturing processes, the first connecting surface 12 and the second connecting surface 22 are substantial parallel to each other, and spacing between the first connecting surface 12 and the second connecting surface 22 substantially is the smallest distance between the first connecting surface 12 and the second connecting surface 22. The water guiding portion 213 has a third spacing L3 at the second direction X when viewed in the cross-sectional direction, and a length ratio of the second spacing L2 to the third spacing L3 is between 1:20 and 1:100. The first water outlet 112 has a fourth spacing L4 at the second direction X when viewed in the cross-sectional direction, and a length ratio of the second spacing L2 to the fourth spacing L4 is greater than 1:1 and less than or equal to 1:3.

Referring to FIG. 6 again, in this embodiment, the first connecting surface 12 of the water inlet unit 10 is disposed with an abutting portion 13 protruding toward the second connecting surface 22 of the water outlet unit 20, and the abutting portion 13 is abutted on the second connecting surface 22. However, the present disclosure is not limited thereto, that is, the abutting portion 13 may also be protruded from the second connecting surface 22 of the water outlet unit 20 toward the first connecting surface 12 of the water inlet unit 10 (not shown in the figure).

In addition, as shown in FIG. 1, FIG. 3, FIG. 4, FIG. 5, and FIG. 6, in this embodiment, the first side wall 41 of the first sleeve 40 is disposed with at least one venting through hole 43 communicating with the first accommodating chamber 32 at a position corresponding to the first accommodating chamber 32, and the first flange 42 of the first sleeve 40 is convexly disposed inwardly to abut and limit a position of the aerator mesh assembly 50. In this embodiment, two of the venting through holes 43 are provided, the venting through holes 43 communicate with the first accommodating chamber 32 of the air inlet groove 30, and the water inlet unit 10 and the water outlet unit 20 are accommodated in the first sleeve 40. The second water inlet 211 is located at the second connecting surface 22 and is tapered toward the water guiding portion 213, and the second water outlet 212 is enlarged toward the water guiding portion 213 at the first direction Z. The water inlet unit 10 is disposed on the water outlet unit 20, and the second passage 21 communicates with the first passage 11 and the third passage 31. The venting through hole 43 not only allows the outside air to enter the air inlet groove 30, but the venting through hole 43 also facilitates cleaning of the micro bubble generating device 100 by a user by means of needle, gas injection or liquid injection. Wherein two of the venting through holes 43 are preferably disposed in the first side wall 41 as in the present embodiment, but one or more than two of the venting through holes 43 can also be disposed, for example, three of the venting through holes 43 are disposed in the first side wall 41.

In this embodiment, each of the first passages 11 is tapered from the first water inlet 111 toward the first water outlet 112, and the fourth spacing L4 at the first water outlet 112 is smaller than a diameter of the second water inlet 211 at a extending position of the second connecting surface 22, so that after the water passes through the first passage 11, the water is pressurized first due to the tapered diameter and then flow to the second passage 21, and a Venturi effect is occurred in the air inlet groove 30 to cause the external air to pass through the first accommodating chamber 32 and the third passage 31 of the air inlet groove 30 from the venting through hole 43, and allow the external air to be mixed with the water in the first passage 11. Then, the water mixed with the external air flows into the second passage 21. As shown in FIG. 4, FIG. 5 and FIG. 6, after the water passes through the first water outlet 112 of the first passage 11, a negative pressure will be generated in the second water inlet 211 with a larger diameter and the third passage 31. After the air is introduced into the first accommodating chamber 32 through the venting through hole 43, the air passes through the third passage 31 from the first accommodating chamber 32 to generate a vigorous air-liquid mixing effect with the water at the second water inlet 211 of the second passage 21. Thus, not only that the density and the number of bubbles generated are increased by reducing the length of the second spacing L2 of the air inlet groove 30, and further, the water pressure requirement of negative pressure for generating the Venturi effect is reduced because a path length of the air passing through the third passage 31 is shortened.

Figure 9:
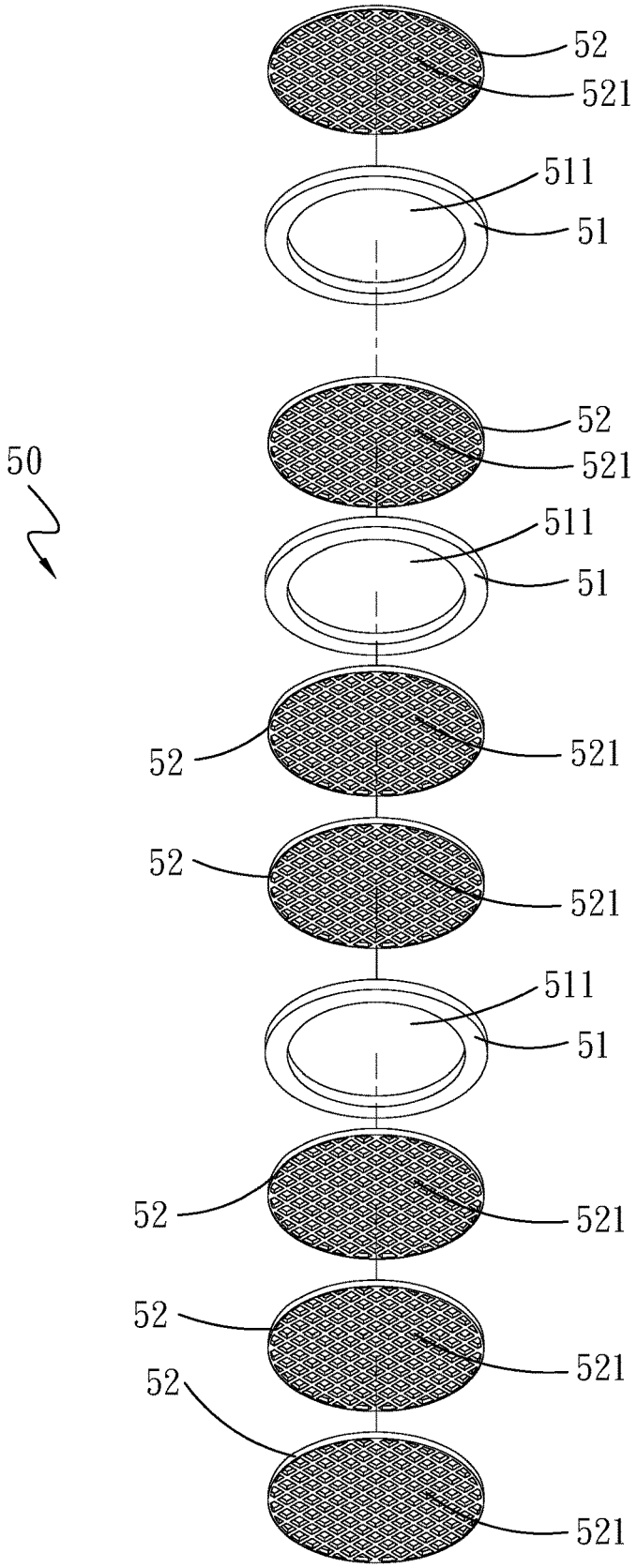
FIG. 9 is an exploded perspective view of an aerator mesh assembly of the present invention.

Referring to FIG. 9, in order to increase the number of bubbles outputted by the aerator mesh assembly 50 of the micro bubble generating device 100, each of the aerator meshes 52 comprises the sieve holes 521. Further, the amount of the aerator mesh 52 disposed at the side of the partition 51 which is farther from the second connecting surface 22 is larger. Besides, since the larger amount of the aerator meshes 52 corresponds to the smaller size of the sieve holes 521 projected onto the second connecting surface 22, the size of the sieve holes 521 of three aerator meshes 52 is smaller than the one of two aerator meshes 52 when projecting on the second connecting surface 22, and the size of the sieve holes 521 of two aerator meshes 52 is smaller than the one of single aerator mesh 52 when projecting on the second connecting surface 22. For example, in this embodiment, three aerator meshes 52 and one partition 51 are provided at the position which is farthest from the second connecting surface 22, and then two aerator meshes 52 and the partition 51 are provided, and then one aerator mesh 52 is provided at the position which is nearest to the second connecting surface 22. That is, different amounts of the aerator meshes 52 are separated by the partitions 51. Besides, when viewing the sieve holes 521 projected on the second connecting surface 22 from the first direction Z, the sizes of the sieve holes 521 with different amounts of the aerator meshes 52 are different since different amounts of the aerator meshes 52 are stacked and overlapped together. Therefore, the aerator meshes 52 located at the position farther from the second connecting surface 22 not only comprises the larger amount of the aerator meshes 52, but also have the smaller size of the sieve holes 521 projected onto the second connecting surface 22. Furthermore, in this embodiment, another partition 51 and another aerator mesh 52 are further disposed on the aerator mesh 52 located at the position closest to the second connecting surface 22 to filtrate impurities in water. When the invention is used in a general household faucet, or in a sprinkler for car washing or agriculture, the size of the sieve holes 521 of each of the aerator meshes 52 is preferably between 0.048 mm and 0.3 mm depending on the amount of water flowing through, and a height of each of the partitions 51 parallel to the first direction Z is preferably between 0.2 mm and 1 mm, however, the disclosure is not limited thereto.

Figure 7:
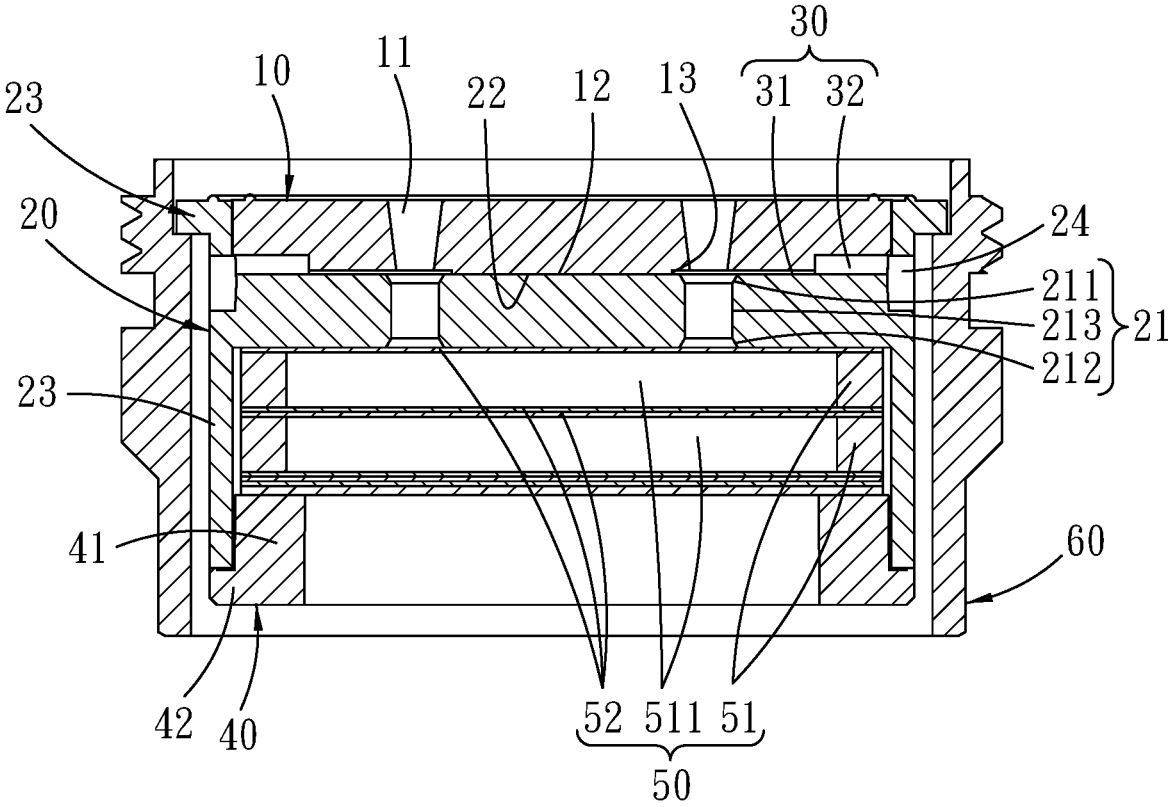
FIG. 7 is a cross-sectional view of a second embodiment of the present invention.

As shown in FIG. 7, in a second embodiment of the present invention, the water outlet unit 20 is formed with a second side wall 23 parallel to the first direction Z, and the second side wall 23 is circumferentially disposed around the water inlet unit 10, the aerator mesh assembly 50 and the first side wall 41. The second side wall 23 is disposed with at least one venting through hole 24 communicating with the first accommodating chamber 32 at a position corresponding to the first accommodating chamber 32, and the first flange 42 of the first sleeve 40 is convexly disposed outwardly to abut and limit a position of the second side wall 23.

Figure 8:
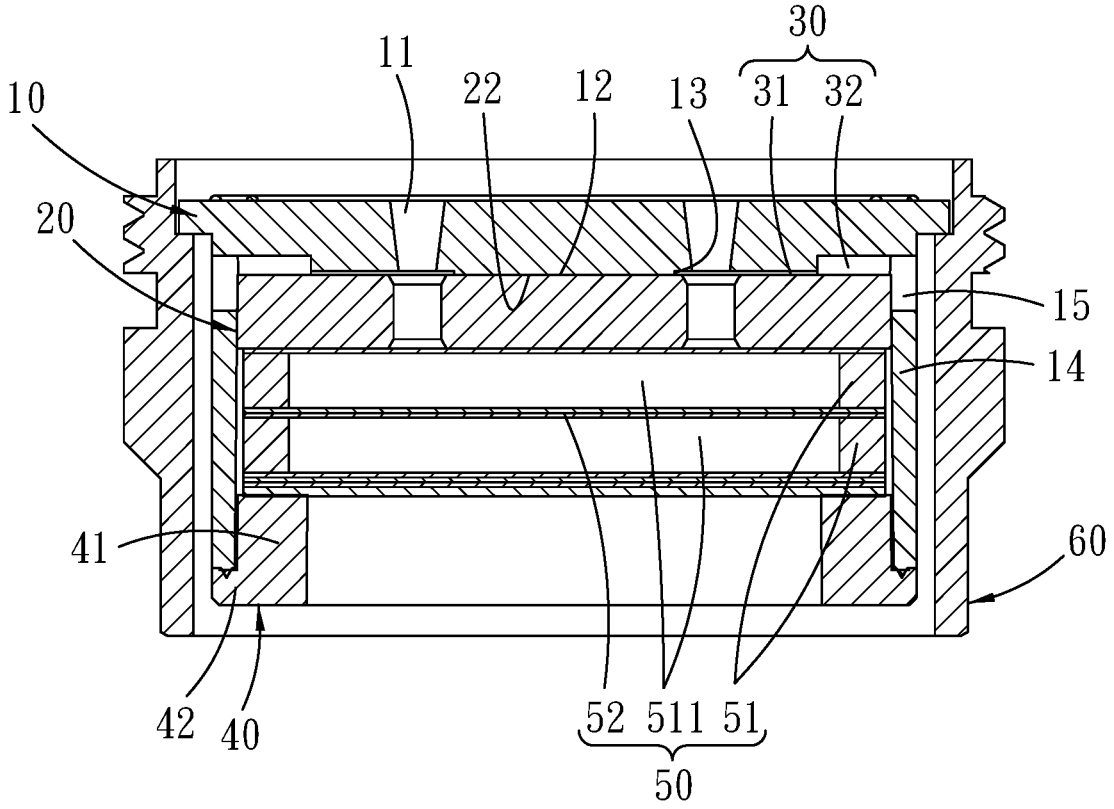
FIG. 8 is a cross-sectional view of a third embodiment of the present invention.

As shown in FIG. 8, in a third embodiment of the present invention, the water inlet unit 10 is formed with a third side wall 14 parallel to the first direction Z, and the third side wall 14 is circumferentially disposed around the water outlet unit 20, the aerator mesh assembly 50 and the first side wall 41. The third side wall 14 is disposed with at least one venting through hole 15 communicating with the first accommodating chamber 32 at a position corresponding to the first accommodating chamber 32, and the first flange 42 of the first sleeve 40 is convexly disposed outwardly to abut and limit a position of the third side wall 14.

What is claimed is:

1. A micro bubble generating device, disposed at one end of a liquid supply device, the micro bubble generating device comprising:

a water inlet unit, comprising at least one first passage penetrating the water inlet unit, and a side of the water inlet unit penetrated by the first passage being provided with a first connecting surface;

a water outlet unit, comprising at least one second passage penetrating the water outlet unit, a side of the water outlet unit penetrated by the second passage being provided with a second connecting surface, the second connecting surface facing the first connecting surface, wherein the water inlet unit is disposed on the water outlet unit, and the second passage communicates with the first passage;

an air inlet groove, formed between the first connecting surface of the water inlet unit and the second connecting surface of the water outlet unit, and the air inlet groove comprising a third passage and a first accommodating chamber circumferentially disposed around the third passage; and a first sleeve, disposed at a side of the water outlet unit opposite to the second connecting surface, the first sleeve being formed with a first side wall parallel to a first direction, an end of the first sleeve being formed with a first flange parallel to a second direction, and the first direction being orthogonal to the second direction;

wherein the first connecting surface and the second connecting surface partially abut against each other; and wherein the first accommodating chamber has a first spacing between the first connecting surface and the second connecting surface, the third passage has a second spacing between the first connecting surface and the second connecting surface, and the first spacing is different from the second spacing.

2. The micro bubble generating device as claimed in claim 1, wherein the first connecting surface of the water inlet unit is to disposed with an abutting portion protruding toward the second connecting surface of the water outlet unit, the abutting portion is abutted at the second connecting surface, the third passage is circumferentially disposed around the abutting portion.

3. The micro bubble generating device as claimed in claim 1, wherein an end of the first passage is defined as a first water inlet and another end of the first passage is defined as a first water outlet, the first water outlet is located at the first connecting surface, and the first passage is tapered from the first water inlet toward the first water outlet.

4. The micro bubble generating device as claimed in claim 3, wherein an end of the second passage is defined as a second water inlet and another end is defined as a second water outlet, a water guiding portion is disposed between the second water inlet and the second water outlet, the second water inlet is located at the second connecting surface, and is tapered toward the water guiding portion, and the second water outlet is enlarged toward a direction away from the water guiding portion.

5. The micro bubble generating device as claimed in claim 4, wherein the water guiding portion has a third spacing at the second direction, and a length ratio of the second spacing to the third spacing is between 1:20 and 1:100.

6. The micro bubble generating device as claimed in claim 4, wherein the first water outlet has a fourth spacing at the second direction, and a length ratio of the second spacing to the fourth spacing is greater than 1:1 and less than or equal to 1:3.

7. The micro bubble generating device as claimed in claim 6, wherein the fourth spacing is smaller than the second water inlet at an extending position of the second connecting surface.

8. The micro bubble generating device as claimed in claim 1, wherein the first spacing is greater than the second spacing.

9. The micro bubble generating device as claimed in claim 1, wherein the second connecting surface of the water outlet unit is disposed with an abutting portion protruding toward the first connecting surface of the water inlet unit, the abutting portion is abutted at the first connecting surface, and the third passage is circumferentially disposed around the abutting portion.

10. The micro bubble generating device as claimed in claim 1, wherein the water outlet unit is formed with a second side wall parallel to the first direction, the second side wall is circumferentially disposed around the water inlet unit and the first side wall, and the second side wall is disposed with at least one venting through hole corresponding to the first accommodating chamber and communicating with the first accommodating chamber.

11. The micro bubble generating device as claimed in claim 1, wherein the water inlet unit is formed with a third side wall parallel to the first direction, the third side wall is circumferentially disposed around the water outlet unit and the first side wall, and the third side wall is disposed with at least one venting through hole corresponding to the first accommodating chamber and communicating with the first accommodating chamber.

12. The micro bubble generating device as claimed in claim 1, wherein the first side wall of the first sleeve is disposed with at least one venting through hole corresponding to the first accommodating chamber and communicating with the first accommodating chamber, and the water inlet unit and the water outlet unit are accommodated in the first sleeve.

13. The micro bubble generating device as claimed in claim 1, further comprising a second sleeve, the second sleeve accommodating the water inlet unit, the water outlet unit, the air inlet groove and the first sleeve, and fixing the micro bubble generating device to the liquid supply device.

14. The micro bubble generating device as claimed in claim 1, further comprising a aerator mesh assembly, disposed between the water outlet unit and the first sleeve, wherein the aerator mesh assembly comprises at least one partition and at least one aerator mesh disposed at a side of the partition along the first direction, the partition has a fourth passage penetrating through the partition, the fourth passage communicates with the second passage, and each of the aerator meshes further has a plurality of sieve holes.

15. The micro bubble generating device as claimed in claim 14, wherein a size of each of the sieve holes is between 0.048 mm and 0.3 mm.

16. The micro bubble generating device as claimed in claim 14, wherein another side of the partition along the first direction disposed with at least one aerator mesh, a number of the aerator meshes disposed at the two sides of the partition is increased as a distance from the second connecting surface is increased.

17. The micro bubble generating device as claimed in claim 16, wherein projections of the sieve holes of the aerator meshes disposed at two sides of the partition onto the second connecting surface is smaller as the distance from the second connecting surface is increased.

18. The micro bubble generating device as claimed in claim 14, wherein a height of each of the at least one partition at the first direction is preferably between 0.2 mm and 1 mm.

* * * * *